US006446560B1

(12) United States Patent
Slocum

(10) Patent No.: US 6,446,560 B1
(45) Date of Patent: Sep. 10, 2002

(54) SINGLE CARRIAGE ROBOTIC MONORAIL MATERIAL TRANSFER SYSTEM

(75) Inventor: Alexander H. Slocum, Bow, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 09/605,941

(22) Filed: Jun. 28, 2000

(51) Int. Cl.[7] ..... B61J 3/00
(52) U.S. Cl. ..... 104/88.03; 104/93; 105/150
(58) Field of Search ..... 104/88.03, 88.02, 104/89, 93, 124, 126, 295; 105/148, 150, 153, 154, 156; 246/3, 167 R, 262, 263; 318/742, 779; 46/253

(56) References Cited

U.S. PATENT DOCUMENTS 2,920,581 A * 1/1960 Cook et al. ..... 104/93
2,997,003 A * 8/1961 Thompson ..... 104/93
3,724,387 A * 4/1973 Civitarese ..... 104/93
3,739,424 A * 6/1973 Gonsalves et al. ..... 104/93
3,935,822 A * 2/1976 Kaufmann ..... 104/93
4,037,358 A * 7/1977 Rosenbaum ..... 46/253
4,207,508 A * 6/1980 Habisohn ..... 318/742
4,374,353 A * 2/1983 Habisohn ..... 318/799
4,602,567 A * 7/1986 Hedstrom ..... 104/93
4,926,753 A * 5/1990 Weiss ..... 104/88.03
5,715,755 A * 2/1998 Jonischkeit et al. ..... 104/93

* cited by examiner

*Primary Examiner*—S. Joseph Morano
*Assistant Examiner*—Lars A. Olson
(74) *Attorney, Agent, or Firm*—Edmund J. Walsh

(57) ABSTRACT

A system to automate distribution of materials and tooling to production machines, where a very simple cross-section track, such as a circle or an X, is anchored to the equipment and to load/unload stations for materials and tooling, and where simple one or two wheeled robotic cars, where the wheels need not be mounted with yaw pivots to the cars, transport the materials or tooling. A control system keeps controls the motor or motors that drive one or two wheels to minimize pitch of the cars as they move along the track.

19 Claims, 6 Drawing Sheets

SINGLE CARRIAGE ROBOTIC MONORAIL MATERIAL TRANSFER SYSTEM

This invention relates generally to factory automation equipment and more specifically to material distribution systems.

Automating material transfer between machines and storage areas in a factory is a very mature field, and hundreds of patents and known methods exist. Examples of known methods include conveyors, guided vehicles, rail-based systems and autonomous vehicles. However, virtually all these approaches either fall short in flexibility or cost too much. Furthermore, most flexible or semi-flexible systems evolved for the automotive industry, and thus they are designed to carry heavy loads so they are mechanically complex. In price-sensitive applications, therefore, batch processing with hard automation, such as transfer lines, or humans carrying containers has been the norm. However, with lot sizes decreasing as customer demand for customization increases, there exists a need for a very low cost, flexible and reliable material transport system for factory automation.

As an example of a system currently used in semiconductor manufacture, PRI Automation, in Billerica Mass., has been basing an automation system on U.S. Pat. No. 4,926,753 "Flexible material transport system" and subsequent related patents such as U.S. Pat. No. 5,673,804 "Hoist system having triangular tension members". Competitors, such as Murata and Daifuku in Japan, have similar systems in that they are also based on a track with a robotic car that has two sets of wheel systems, or bogies as they are known in railroad terms. In effect these companies have miniaturized well-known railroad solutions; however, this adds a great deal of complexity and cost just in terms of the number of parts.

For the manufacture of parts on silicon wafers, the so-called front-end of semiconductor manufacturing, the high cost was justifiable. For the so-called back-end, which involves packaging and testing the devices, the product density is much lower, and the allowable costs are also much lower; hence such systems have not been justifiable, and most work is still done by people transporting materials. It is interesting to note that railroads are designed with a set of functional requirements that emphasize stability when the load is carried on top of the car, and this seems to have driven the development of automation for the front end. Even systems, such as sold by Murata, that carry the load beneath the car still use the double bogie railroad car design. Perhaps this is so because these systems are also often sold in a scaled-up mode for large load capacity systems that need pitch resistance.

In some systems, the load hangs below the cart. However, such systems have not generally been used in factory automation equipment, with such systems more likely to be used in aerial tramways and meat packing plants. In these cases, the payload is carried by structure that is mounted to a carriage with a pivot mount, which is called a "beef trolley". This eliminates the need for two independent wheel carriage systems, which greatly reduces cost and complexity. A beef trolley, however, is not motorized, but is moved along by contact with a chain, or it is pulled manually. In addition, the use of only one wheel results in substantial swinging.

SUMMARY OF THE INVENTION

With the foregoing background in mind, it is an object of the invention to provide a system for transferring materials between machines and storage systems.

The foregoing and other objects are achieved in a material transport system having a track with carts riding on the track. Material is carried on each cart. In one embodiment, the carts have one or more wheels that engage the track and the track and the wheels are shaped to provide limited points of contact between the wheels and the track, thereby providing a marginally over-constrained system that is stable.

In other embodiments, the carts are balanced to hang on the track, with the load suspended below the cart. In certain embodiments, the balance is enhanced by a gyro-stabilizer in the cart.

In the preferred embodiment, each of the carts is motorized and can move rapidly around a track that has bends and inclines to allow three dimensional motion of the cart.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
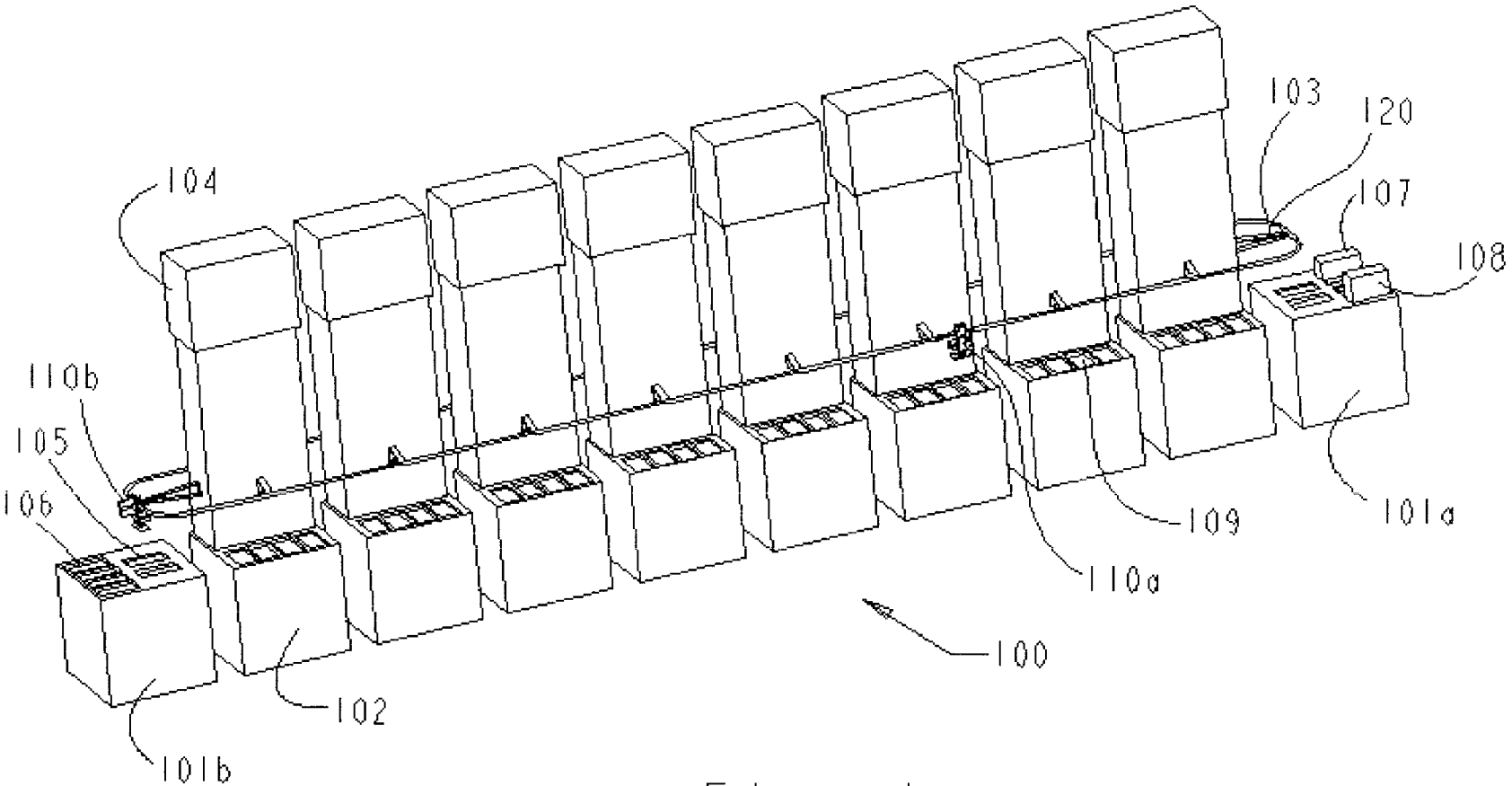
FIG. 1 shows an isometric view of a system of process machines serviced by the automation system and load/unload machines.

FIG. 1 shows a material handling system of the invention used in a manufacturing area 100. The invention might be employed in conjunction with many types of manufacturing processes in which materials need to be moved from one station to another. Hereinafter, the material handling system will be described in conjunction with a manufacturing process for semiconductor devices and particularly for the test portion of the semiconductor manufacturing operation. In the illustration, the work stations perform test related operations. Various materials might be moved as part of a semiconductor manufacturing operation. The semiconductor devices being tested must be moved from an input area, to test stations and then to an output area where they can be passed on to the next stage in the manufacturing operation.

The semiconductor manufacturing system used to illustrate the invention includes two end stations 101*a* and 101*b* and six testing stations. Each of the testing stations has a handler unit such as 102 and test heads 104. The handler unit receives the semiconductor devices to be tested and presents them to the test head.

The work stations are linked to the end stations by a track 103, described in greater detail below, held by supports such as 120. The semiconductor devices to be tested are held in modular cassettes such as 108 that are placed on the end stations in receiving areas such as 106 by workers or other automation systems. The end stations 101*a* and 101*b* preferably have mechanisms in them, known to those skilled in the art of automation systems, to move the cassette to an area 105 which is directly underneath the track 103.

The material transport system might also be used to transport things to and from the test stations other than the semiconductor devices being tested. Electrical contactors, or other tooling to be robotically loaded into the test heads could also be held in modular cassettes such as 107. The robotic systems for loading and unloading material from the cassettes are not shown, but such are known in the art.

Robotic cars such as 110*a* and 110*b*, described in greater detail below, travel along the track 103 to move cassettes from end stations 101 to handler units 102 and back again after the contents of the cassettes have been processed. The handlers 102 have receiving stations 109 to receive either cassettes of parts or tooling. In the disclosed embodiment, the system advantageously uses simple, low cost, and easy to install track 103 and simple two-wheeled robotic car units 110.

A control system controls the position of the cars 110 as part of the manufacturing operation. As will be described in greater detail below, The control system will be able to control the position of the cart along the track. In some embodiments, the control system will also control the pitch of the cart relative to the track.

The control system sends commands to each of the cars 110 to control the speed and direction of the car. The cars could also send information to the control system about their position, orientation, speed, acceleration or other variables that the control system might use as inputs for computing commands. This information might be obtained from sensors as known in the art (not shown) mounted on the cars.

Information might be exchanged between the cars and the control system in any known fashion. If the control system is centralized, the information could be transmitted over a radio link. However, other forms of control links are known and could work adequately, such as hard wiring or IR wireless links.

Alternatively, the control system for the carts might be distributed in control electronics located at each work station. Commands might then be passed to each car when it picks up or drops off a cassette. The commands would indicate the next place the car should travel to. Signals to control the speed and other operating characteristics of the cars might then be generated from the commands by microcontrollers on the cars.

Figure 2:
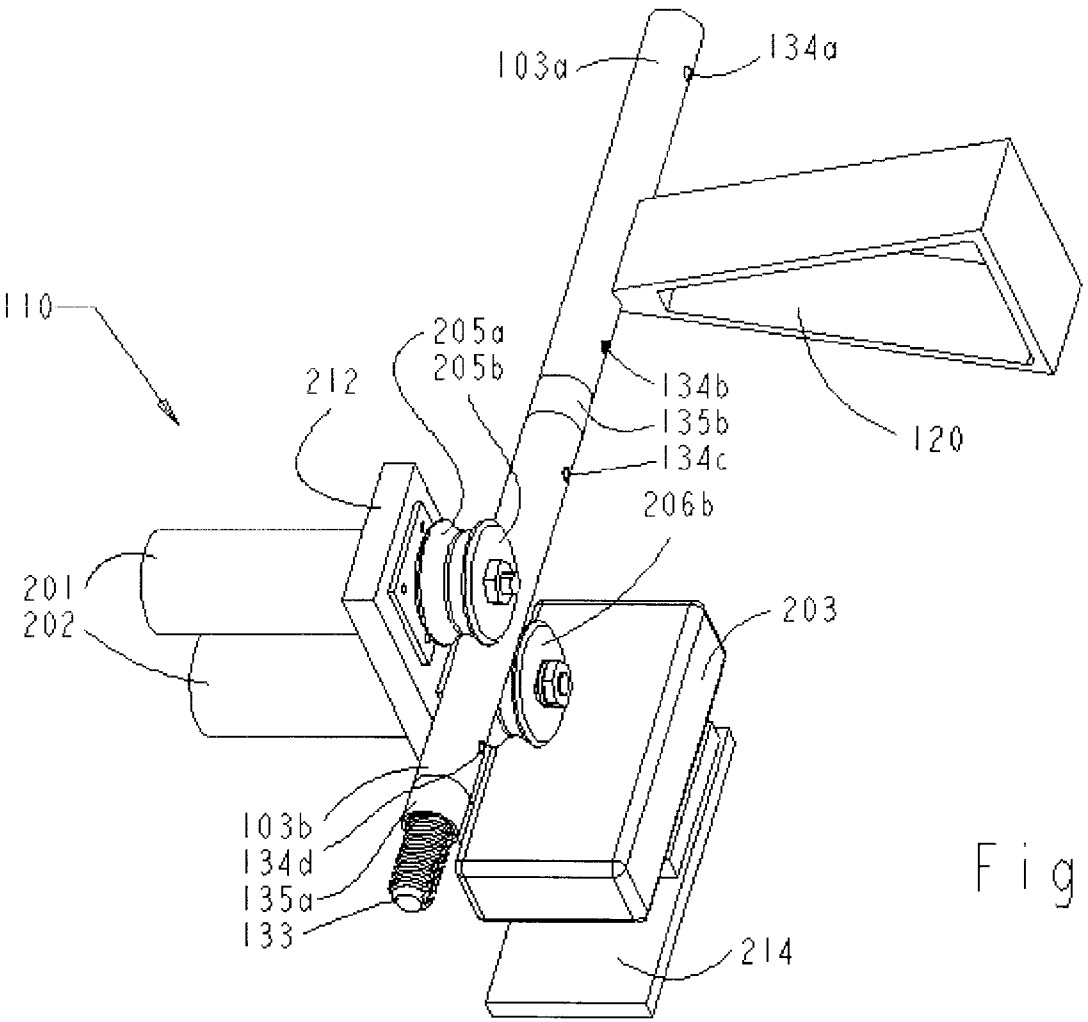
FIG. 2 shows an isometric view of one of the robotic car units and a section of round tubular track.
Figure 3:
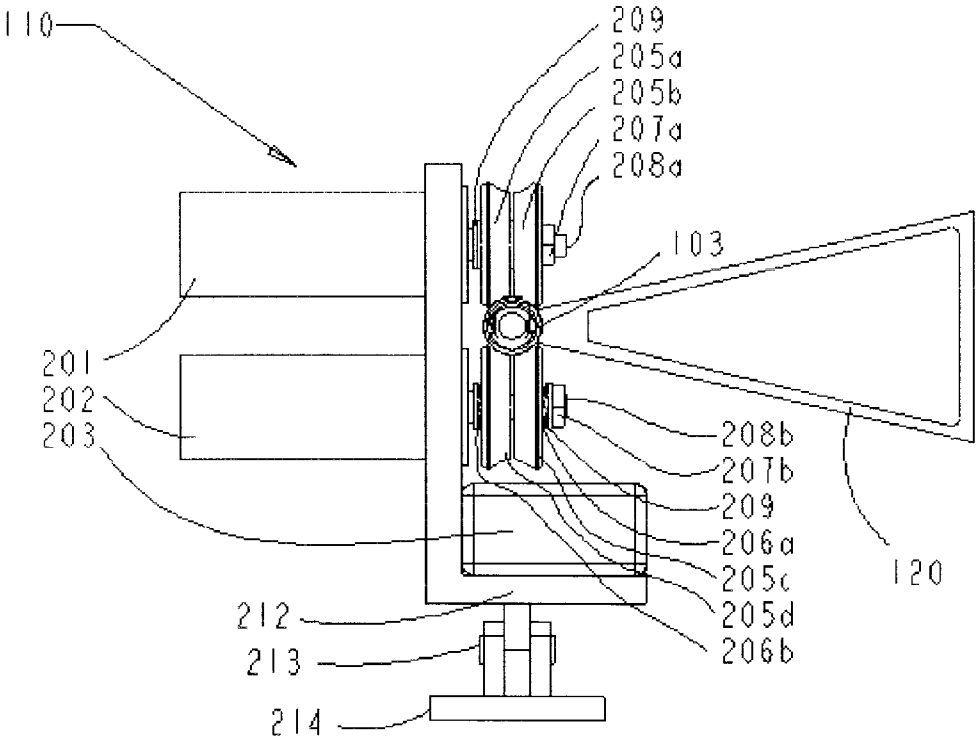
FIG. 3 shows an end view of one of the robotic car units.

FIGS. 2 and 3 show one of the robotic car units 110 in greater detail. The unit is driven by a pair of drive motors 201 and 202 that drive wheels 205 and 206 along track 103. The signals that drive them motors are generated by the control system.

It is not necessary that two drive wheels be used. However, two wheels provide good traction and stability, although reasonable stability can sometimes be achieved with just one motor driven wheel to make the system even simpler to build.

The motors are attached to the frame 212. An electronics box 203 contains control circuitry and batteries as are widely known in the area of robotic vehicles, which are commonly used in factories.

The two motors allow the cart to be controlled to reduce pitch of the cart, and hence allow it to operate at an increased speed. When the wheel 205 above track 103 and wheel 206 below track 103 are rotated in opposite directions, they will generate a force on car 110 in the same direction. Thus, car 110 will be propelled along track 103. The direction of motion is dictated by the direction of rotation of the wheels.

However, if the wheels above and below the track 103 are rotated in the same direction, forces in opposing directions will be generated on car 110 through the shafts 208*a* and 208*b* that hold the wheels 205 and 206. The opposing forces will cause a net torque on car 110 through an axis centered between the shafts that hold the wheels 205 and 206. This torque can change the pitch of car 110 or counterbalance a force on the car that is tending to change its pitch.

In use, the motions that propel the cart and the motions that change its pitch or compensate for torque can be combined such that pitch can be controlled as the car moves along track 103. Combining the motions means that the wheels can be driven in opposite directions, though at different rates of speeds.

An inclinometer mounted inside the electronics box 203 can be used to measure the pitch of the car 110. As described above, a microcontroller, also part of electronics box 203, could then compute the required rotation on each motor 201 and 202 to set the pitch to the required angle.

One benefit of controlling the pitch of car 110 is that the force between each of the wheels 205 and 206 and track 103 can be maintained nearly constant even if the track has hills or valleys in it. This result is achieved by setting the pitch of the car to keep the car perpendicular to track 103.

One way that the pitch of the car can be controlled in this fashion is through the use of a central controller programmed with the profile of the track for every point along the track. Based on the position of the car, the central controller would issue commands specifying the pitch of the car based on the position of the cart. The microcontroller onboard the cart would adjust the relative speed of the wheels until the desired pitch was obtained. Thus it would be simple for the car to travel up hills or down hills as well as around corners.

It is desirable to control the pitch of the two-wheeled cart going up a hill to keep the line between the wheels nominally normal to the track. This orientation keeps the center distance between the wheels nearly constant and maintains proper preload between the wheels and the track. Maintaining a preload force in turn keeps the cart on the track and provides smooth motion. In the presently illustrated embodiment, that preload force is maintained as the cart moves up and down hills and around curves.

Improving the ability of the cart to move up and down hills and around curves allows the material transport system to be used with a track that has three dimensional motion capability. In particular, the elevation of the cart can be changed simply by bending the track to the desired elevation. One benefit that can be obtained is that expensive elevator systems as are found in some prior art material handling systems are not required to move between different levels in the factory. Accordingly, the invention results in the system being flexible in that it can be installed in many configurations and the cart can also travel at relatively high speeds.

Higher speeds are possible with the added stability that results from maintaining a preload force even as the cart moves up and down hills. Keeping the preload force constant, which in the described embodiments is achieved through pitch control, reduces swaying of the hanging load and also avoids jerking instabilities, in a manner like the wobbling a grocery cart wheel sometimes experiences.

It should, however, be appreciated that the system will operate with a single driven wheel. If only one motor driven wheel and a lower preload wheel is used, the car can still achieve reasonable stability and also could still climb and descend hills. A single wheel system would just not be as fast or as stable as a two wheel system.

In a preferred embodiment, the wheels 205 and 206 are designed to provide good stability. In a preferred embodiment, the wheels are shaped to engage the track 103 in a "marginally over-constrained" manner. By marginally over-constrained, it is meant that the wheels are shaped to touch the track at relatively few points. A minimally constrained system (sometimes called a "kinematic system") has an interface with the minimal number of points of contact necessary to constrain motion. A classic example of this is a 3-legged stool. A stool makes contact with the floor at 3 points, which is the minimum necessary to keep the seat of the stool form moving up or down or tipping sideways. In contrast, a 4-legged chair is over-constrained. It contacts the floor at more points than are necessary to constrain motion.

The 3-legged stool is more stable. Even if the floor is uneven, the 3-legged stool will not rock. In contrast, a 4-legged chair can rock if the floor is uneven or one leg is shorter than the others. As the number of points of contact gets larger —or the more over-constrained the system is —the chance of some imperfection at one side or the other of the interface reducing the stability of the interface increases. Thus, having a minimally constrained interface or an interface that has only a few points of contact more than a minimally constrained interface can be more stable and is therefore desirable. Herein, the term "marginally over-constrained" is used to refer to the idea of having a relatively small number of controlled compliance points of contact at an interface rather than trying to have the pieces on each side of the interface conform over wide surfaces.

In the embodiment shown in FIG. 3, each wheel is designed to touch track 103 at two points rather than trying to conform to the shape of the track over the surface of the wheel. This configuration creates a "marginally over-constrained" interface.

In the embodiment of FIG. 2 and FIG. 3, upper wheel 205 has two identical halves 205*a* and 205*b*. Lower wheel 206 has two identical halves 206*a* and 206*b*. Each of the halves 205*a*, 205*b*, 206*a* and 206*b* is splined or has keyed bores to allow torque to be transmitted to the wheels from the motor shafts (208*a* and 208*b*).

Figure 4:
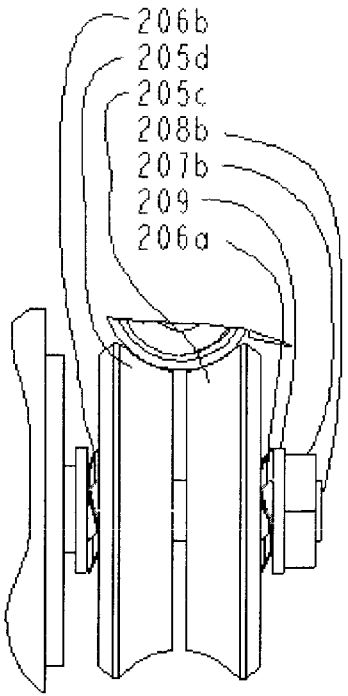
FIG. 4 shows a close up of one of the robotic car units' split spring-preloaded wheels.

The wheels are shaped to contact the track 103 at two points for each wheel so as to minimize differential slip, yet prevent the car unit from yawing about its vertical axis and riding up out of the track. Various shapes could be used for the wheel and the track to provide four points of contact. In the embodiment of FIG. 2-4, both the wheels and the track are rounded, but with different radii of curvature.

The wheels are also sized to pass over the hanger unit 120 that supports the track. They are positioned on the motor shaft 208*a* by spacers 209 and held on by nut 207*a*.

FIG. 4 shows in detail a method for preloading the wheels to the track without requiring one of the motors to be spring-mounted, thereby decreasing complexity and increasing robustness. In order to preload the vehicle to the track 103 so as to increase traction and controllability, the lower wheel 206, comprised of molded halves 206*a* and 206*b* is located on the lower motor shaft 208*b* by spacers 209 and preloaded axially by springs 206*a* and 206*b* which are compressed by nut 207*b*.

Because the wheel halves 206*a* and 206*b* contact the track 103 at an angle, the axial preload force will create a radial preload force between the wheels and the track. The angle is typically between 30 and 45 degrees from the vertical so as to provide good yaw stability on the track, while keeping differential slip, and the associated generation of particles, to an acceptable level.

Differential slip occurs in this instance because the wheel contacts the sides of the track. In a curve, the two sides of the track have different bend radii. Hence when the wheel rolls around the curve, the linear distance traveled by the two different points are different, and some slip must occur between the wheel and the track. This slip is a rubbing action that causes wear. As the parts wear, they generate particles. Particles are undesirable in many applications—particularly in semiconductor manufacturing facilities which are often operated inside "clean rooms."

This arrangement also allows the wheels to achieve a spring loaded preload that still allows the car to assume a marginally over constrained state on the track, despite the four point contact of the upper and lower wheels.

Preferably, the car 110 has a lower structure 214 that is attached to the main structure 212 by a joint system 213 that allows motion of lower structure 214 relative to track 103. When the load is coupled to structure 214, any load held by the car always hangs plumb. In the illustrated embodiment the joint system is a spherical joint. Conventional gripping devices or other devices known to those skilled in the art could be attached to the structure 214, and these would be used to pick up cassettes such as 106.

In order to use a round track shown in FIGS. 2 and 3, the car needs to be balanced, or else as it moves along the track it could roll until it achieves a balanced state. The car 110 has the electronics box 203 positioned below the track to counterbalance the motors and also to lower the center of gravity. Spherical joint 213 is attached to the structure 212 in line with the track 103. Load attachment platform 214, which would use a gripper known to those skilled in the art of robotics, thus is always hanging plumb with the track, so the car 110 will not roll even when carrying different payloads.

This circular shaped track will be easy to bend in either plane, with the use of simple convex vee-shaped dies installed in a standard tube bender; thus the track could easily be installed by tradesman who are used to installing electrical conduit. As shown in FIG. 2, track sections 103*a* and 103*b* have holes in their ends 134*a*, 134*b*, 134*c*, and 134*d* into which spring pins would connect the tracks to threaded pins such as 133. Thread collars 135*a*, and 135*b* can be used to move the pins 133 in or out of a joint when the roll pins are knocked out, thus easily allowing a new section of round track, such as a curve to create a spur line, to be added without disrupting the rest of the track.

There are alternate track sections that allow for simplicity of the car and track design, and that can resist a roll moment, so there is not the requirement to always carry a centered load.

Figure 5:
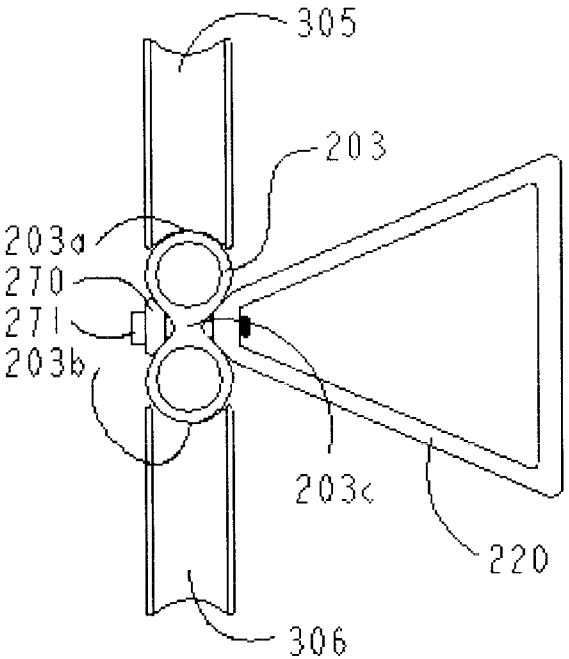
FIG. 5 shows an alternate track form comprised of a FIG. 8 extrusion.

FIG. 5 shows an alternate track form 203 comprised of an 8-shaped extrusion with top round section 203*a* and bottom round section 203*b* joined in the middle by septum 203*c*. The tracks described herein are generally of uniform cross section, which provides the option of forming the tracks through an extrusion process.

Hanger 220 wedges into the space between the round sections 203*a* and 203*b* and a chamfered washer 270 allows a bolt 271 to securely clamp the track 203 to the hanger 220. In this example, solid wheels 305 and 306 are shown, and they can have circular arch profiles to contact the track at the pole positions, to reduce differential slip as a corner is rounded, or they could be marginally over-constrained with four points of contact as shown in FIG. 4, to maximize roll resistance and minimize the chance for derailment. In either case, the instant centers of contact between the top and bottom contacts are not coincident, as is the case for a simple round track; however, this FIG. 8 shape, although easy to bend in a curve whose radius is parallel to the axes of the wheels, will be difficult to bend in a curve whose radius is orthogonal to the wheels' axes, which would be required to climb.

As is known in the art, the instant center of a mechanism is the imaginary point at which for small motions, the system rotates. When a system is constrained by bearings, a single bearing point can constrain the system in a degree of freedom, but a second bearing spaced from the first is required to support a moment load. If however, the instant centers of the bearing are coincident, the system can stiff rotate. This is easy to see for two points supporting a line compared to two points supporting a circle.

Figure 6:
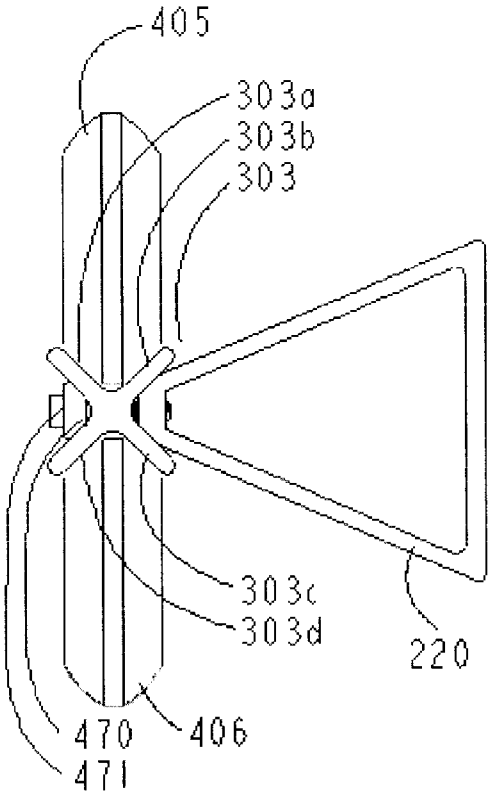
FIG. 6 shows an alternate track form comprised of a X-shaped cross-section.

FIG. 6 shows an alternate track form of track 303 comprised of a X-shaped cross section. Hanger 220 wedges into the side of the X, and a chamfered washer 470 allows a bolt 471 to securely clamp the track 203 to the hanger 220. In this example, solid gothic-arch profile wheels 406 and 306 are shown to contact the X shaped track to create four-point contact to increase roll resistance and decrease the chance for derailment. Wheel 405 makes contact with the X track 303 at points 303*a* and 303*b,* and wheel 406 makes contact with the X track 303 at points 303*c* and 303*d.* The Gothic arch profile allows a user to locally optimize the radius of curvature at the wheel-to-track contact point to reduce contact stresses and differential slip. This X shape track will be easy to bend in either plane, with the use of simple convex vee-shaped dies installed in a standard tube bender; thus the track could easily be installed by tradesman who are used to installing electrical conduit.

Figure 8:
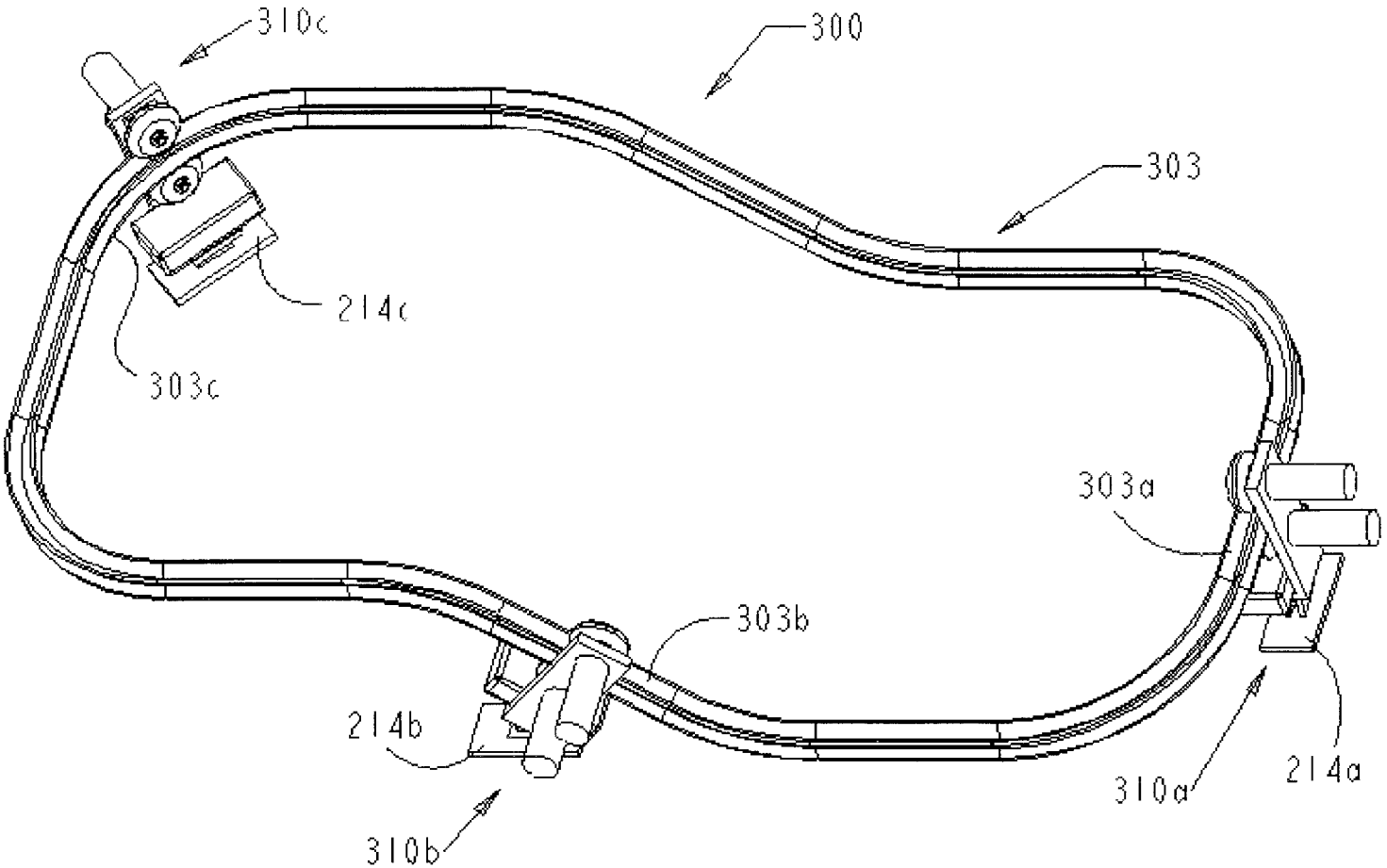
FIG. 8 shows a three dimensional layout of the system with cars on turns, hills, and straight sections of the track.

In order to join sections of the FIG. 8 track 203 or the X track 303, methods similar to joining railroad tracks can be used, where sections span both sides of the tracks and are then bolted through to each of the tracks to form a sandwich.

Figure 7:
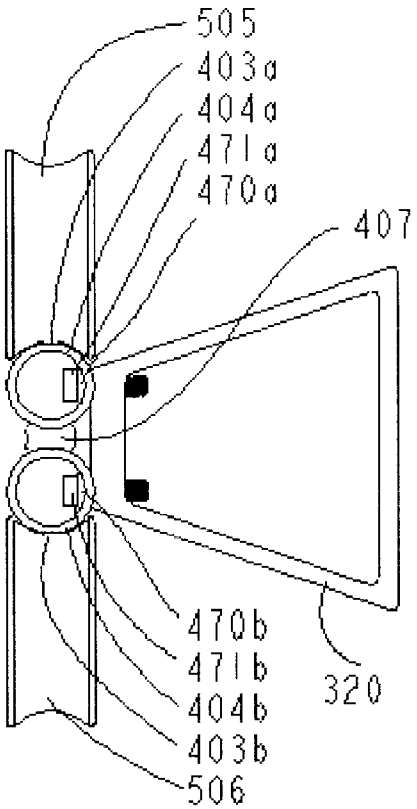
FIG. 7 shows an alternate track form comprised of two tubular sections spaced apart with a simple spacer to give in effect a 8-shaped cross-section.

FIG. 7 shows an alternate track form comprised of two circular tubular sections 404*a* and 404*b* spaced apart with a simple spacer 407 to give in effect an 8-shaped cross section. Hanger 320 has upper and lower circular depressions into which the tubes 404*a* and 404*b* nest, and then curved washers 470*a* and 470*b* allow bolts 471*a* and 471*b* respectively to clamp the tubes to the hanger. Clearance holes for the bolt heads are drilled into the tubes, but this does not affect the system because the clearance holes are outside the contact regions of the wheels. The individual sections of tubes could be joined as shown with the single round tube section in FIG. 2.

Again, in this example, solid wheels 505 and 506 are shown, and they can have circular arch profiles to contact the track at the pole positions 403*a* and 403*b* respectively, to reduce differential slip as a corner is rounded, or they could be four point contact wheels as shown in FIG. 4, to maximize roll resistance and minimize the chance for derailment. Unlike the solid FIG. 8 shape 203, the individual sections 404*a* and 404*b* are individually easy to bend and the spacer 407 can be made from a viscoelastic material to provide compliance and damping. An example of a suitable viscoelastic material is C-1002 made by EAR Specialty Composites Corp. in Indianapolis, Ind.

FIG. 8 shows a three dimensional layout of the system 300 with cars 310*c,* 310*b,* and 310*a* on turns 303*c,* hills 303*b,* and straight sections 303*a* of the track respectively. Note how the spherical pivot mounted platform 214*b* is hanging plumb as the car 310 climbs a hill section 303*b.*

The system of track and cars described above can be configured to supply various types of machines. The cars can be controlled locally using on-board control systems that receive their instructions from the machines which they service or can be controlled from a global factory control system. Such job delivery control methods are well known to those skilled in the art of factory automation.

Figure 10:
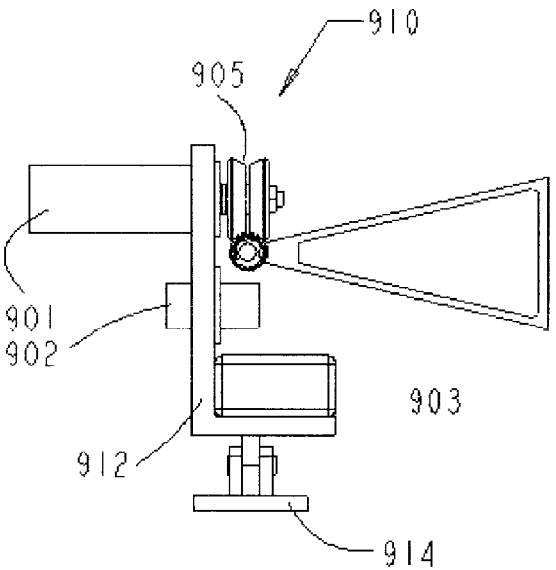
FIG. 10 shows an end view of a single wheel system with a gyrostabilizer.
Figure 9:
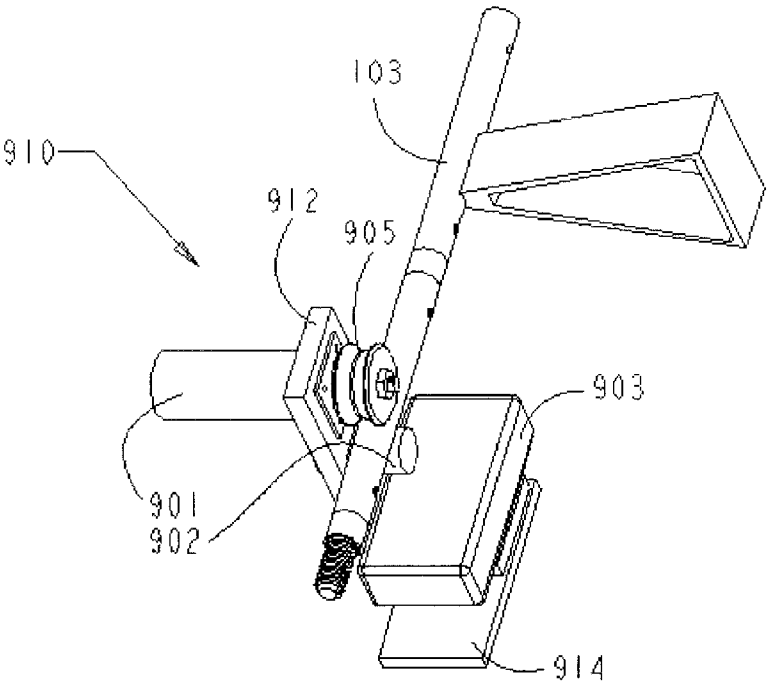
FIG. 9 shows an isometric of a single wheel system with a gyrostabilizer.

In order to further decrease cost and complexity, if one is willing to sacrifice the ability to climb a steep hill, a single wheel can be used with any of these designs. Such designs will be most useful if the load nominally hangs plumb as shown in FIGS. 9 and 10. Only using an upper wheel 905 on the car 910 to run on the track 103 will reduce cost and reduce complexity by reducing the need for preload. The single motor 901 can provide adequate power for a level track or a modest incline climb.

If a gyroscope unit 902 is attached to the frame 912, then tilting motions of the car, such as forward pitch or sideways roll, can be greatly reduced and the load platform 914 stabilized. Advanced control techniques can also be utilized by the controller 903, such as described in U.S. Pat. No. 4,916,635, "Shaping command inputs to minimize unwanted dynamics" and U.S. Pat. No. 5,638,267, "Method and apparatus for minimizing unwanted dynamics in a physical system", make this an attractive option for many applications. A gyroscopic control unit might advantageously be used in conjunction with other embodiments for increased stability.

Having described one embodiment, numerous alternative embodiments or variations might be made. For example, the specific shape of the track could be changed. Ovular tracks could be used. Or, instead of arch shaped wheels, wheels with tapered edges might be used.

Also, it was described in conjunction with systems using two wheels that separate motors drive each wheel. It would be possible to drive both wheels with the same motor. However, the above-described embodiments are preferred because having separate motors makes it easy to drive the wheels at different speeds to control the pitch of the cart. Further, controlling the relative speed of the wheels to achieve a desired pitch of the cart has an additional advantage of compensating for any manufacturing tolerances or different wear rates that result in wheels of different diameters. If the wheels are of different diameters but are turning at the same speed, there will be differential slip between the wheels. As described above, differential slip is undesirable.

Also, in the above-described embodiments, the pay-load is suspended below the cart. The payload might also be mounted above the cart. Various mounting arrangements for the load could be created to keep the force from the load generally in the same direction as when the load is suspended below the cart. Also, where the load is small or a gyrostabilizer is used or where only relatively small pitch adjustments are required because of the layout of the track, less benefit might be obtained from having the load suspended from a joint below the car as described above.

Further, it was described that the objects being transported by the system of the invention are held in cassettes. The specific manner in which the device are held is not important to the invention. They could be held in trays, on strips or even picked up as single objects. The specific device used to pick up the objects is also not important to the invention. Grippers, vacuum pickups or any other known device might be used.

Details of the control system are not described, because control systems are generally known in the art. However, it should be appreciated that many conventional parts of control systems are likely included in the system. For example, position sensors might be used to provide the control system with information about the location of the carts on the track.

As an example of another variation, it was described in conjunction with FIG. 4 that preloaded wheels are used. In the specific embodiment, split wheels are used and the halves are biased against the track through springs applying force in the direction of the shaft. Other pre-load mechanisms could be used, though they might not have the simplicity of the described embodiment. For example, a one-piece wheel could be used and the shaft for that wheel could be biased towards the other.

Further, it is not necessary to pre-load both wheels. Gravity will force the upper wheel into the track. Thus, it is most important to have a spring pre-load for the lower wheel, but a cart could be constructed without pre-loading the upper wheel.

Also, embodiments are described in which there are either two driven wheels or a single driven wheel. It is possible that a cart could be constructed with some driven wheels and some free-spinning wheels. For example, a cart could be constructed with one driven wheel and one free spinning wheel, such as by omitting motor 202 shown in the embodiment of FIG. 3. Preferably, such wheels would be preloaded, for example using the simple wheel structure of FIG. 4.

A system with a single driven wheel would not provide pitch control as described above. However, using opposing pre-loaded wheels provides significant damping and in many cases no pitch control will be required. Thus, a pitch sensor and a pitch control system—though providing important advantages for some applications —should not be considered an essential part of the invention. Other embodiments might be created without achieving all of the advantages of the preferred embodiments.

Therefore, the invention should be limited only by the spirit and scope of the appended claims.

What is claimed is:

1. A material transport system for an automated factory comprising:

a) a track;

b) a cart having:

i) two wheels thereon, disposed on opposite sides of the track;

ii) at least one motor coupled to independently drive each of the wheels; and iii) an electronic unit coupled to the at least one motor operative to control at least one motors to drive the wheels at different speeds, thereby controlling the pitch of the cart.

2. The material transport system of claim 1 additionally comprising:

a) a support structure having the motors mounted thereto b) a second structure adapted to hold a pay load; and c) a joint coupling the second structure to the support structure.

3. The material transport system of claim 1 wherein at least one of the wheels is pre-loaded against the track.

4. The material transport system of claim 1 wherein one of the wheels is attached to the cart above the track and is thereby biased into the track by gravity and a second of the wheels is mounted below the track and the cart comprises a spring pre-load biasing the second of the wheels into the track.

5. The material transport system of claim 1 wherein the track is tubular and the wheels are on opposing sides of the track.

6. The material transport system of claim 1 wherein the electronic control system comprises a pitch sensor.

7. The material transport system of claim 2 wherein the joint comprises a bearing between the support structure and the second structure whereby the second structure hangs plumb.

8. The material transport system of claim 1 wherein the track has bends and hills therein, thereby creating a three dimensional profile.

9. The material transport system of claim 8 wherein the track has a circular cross-section.

10. The material transport system of claim 8 wherein the track has an 8-shaped cross-section.

11. The material transport system of claim 8 wherein the track has an X-shaped cross-section.

12. The material transport system of claim 8 wherein the track comprises a plurality of sections of similar cross section joined together.

13. The material transport system of claim 8 additionally comprising a gyroscopic stabilizer.

14. The material transport system of claim 8 wherein the electronic unit comprises a pitch sensor.

15. The material transport system of claim 1 wherein the cart has only two wheels.

16. The material transport system of claim 15 wherein one of the wheels is pre-loaded against the track.

17. The material transport system of claim 1 wherein each of the wheels includes:

a) a shaft;

b) at least two wheel portions mounted on the shaft and disposed to roll along the track, at least one of the wheel portions slide-ably mounted along the shaft; and c) a spring member mounted to bias the slide-ably mounted wheel portion along the shaft towards the track.

18. The material transport system of claim 14 additionally comprising at least two motors, each mounted to drive a shaft.

19. The material transport system of claim 18 additionally comprising an electronic control system coupled to the first motor and the second motor.

* * * * *